US008276743B2

(12) United States Patent
Zimmermann

(10) Patent No.: US 8,276,743 B2
(45) Date of Patent: Oct. 2, 2012

(54) METHOD AND APPARATUS FOR THE REVERSAL OF DIRECTION IN THE TRANSPORT OF ARTICLES

(75) Inventor: Armin Zimmermann, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 23 days.

(21) Appl. No.: 13/041,741

(22) Filed: Mar. 7, 2011

(65) Prior Publication Data

US 2011/0214964 A1 Sep. 8, 2011

(30) Foreign Application Priority Data

Mar. 5, 2010 (DE) ..... 10 2010 010 375

(51) Int. Cl.
*B65G 47/24* (2006.01)

(52) U.S. Cl. ..... 198/406; 198/411; 271/225; 271/184

(58) Field of Classification Search ..... 198/406, 198/407, 410, 411, 413, 502.2; 271/3.19, 271/4.06, 225, 227, 302, 184, 186
See application file for complete search history.

(56) References Cited

U.S. PATENT DOCUMENTS

| | | | | |
|---|---|---|---|---|
| 4,299,379 | A * | 11/1981 | Preston et al. | 271/215 |
| 5,224,697 | A * | 7/1993 | Darchis et al. | 271/215 |
| 5,449,166 | A | 9/1995 | Lohmann et al. | |
| 5,649,698 | A * | 7/1997 | Auerbach et al. | 271/225 |
| 6,062,556 | A * | 5/2000 | McCay | 271/225 |
| 6,666,324 | B2 * | 12/2003 | Engarto et al. | 198/406 |
| 6,719,126 | B2 * | 4/2004 | Badier et al. | 198/413 |
| 7,029,002 | B2 * | 4/2006 | Engarto et al. | 271/184 |
| 7,080,834 | B2 | 7/2006 | Asari | |
| 7,306,219 | B2 | 12/2007 | Keil et al. | |
| 7,687,737 | B2 | 3/2010 | Zimmermann et al. | |
| 7,694,953 | B2 | 4/2010 | Hiramitsu et al. | |
| 2007/0040325 | A1 | 2/2007 | Matsumoto et al. | |
| 2007/0216085 | A1 | 9/2007 | Asari et al. | |

FOREIGN PATENT DOCUMENTS

DE 10 2004 012 378 B3 9/2005

(Continued)

OTHER PUBLICATIONS

German Patent and Trademark Office Search Report Dated Oct. 6, 2010.

*Primary Examiner* — James R Bidwell
(74) *Attorney, Agent, or Firm* — Laurence A. Greenberg; Werner H. Stemer; Ralph E. Locher

(57) ABSTRACT

A method and an apparatus enable the reversal of direction in a transport of articles, in particular flat mail items. The length of the leading article is measured. The two articles are transported, with a gap between them, to a direction reversal device. The direction reversal device possesses a "head station" and transports the two articles over a transport path in a transport direction and, subsequently, over the same transport path in the opposite transport direction. If the measured length is greater than a stipulated standard maximum length, the leading article is additionally transported over an additional transport route which follows the transport path, specifically, first, in the transport direction and, subsequently, in the opposite transport direction. The two articles are subsequently transported away in succession.

8 Claims, 4 Drawing Sheets

FOREIGN PATENT DOCUMENTS

| | | | |
|---|---|---|---|
| DE | 10 2004 026 362 | B3 | 11/2005 |
| DE | 10 2006 027 872 | A1 | 12/2007 |
| EP | 1 424 299 | A2 | 6/2004 |
| EP | 1 529 747 | A1 | 5/2005 |
| EP | 1 529 754 | A1 | 5/2005 |
| EP | 1 754 675 | A1 | 2/2007 |
| EP | 1 834 910 | A2 | 9/2007 |
| WO | 2007/144420 | A1 | 12/2007 |

* cited by examiner

METHOD AND APPARATUS FOR THE REVERSAL OF DIRECTION IN THE TRANSPORT OF ARTICLES

CROSS-REFERENCE TO RELATED APPLICATION

This application claims the priority, under 35 U.S.C. §119, of German application DE 10 2010 010 375.6, filed Mar. 5, 2010; the prior application is herewith incorporated by reference in its entirety.

BACKGROUND OF THE INVENTION

Field of the Invention

The invention relates to a method and an apparatus for the reversal of direction in the transport of articles, in particular of flat mail items.

A method and an apparatus of this general kind is described in patent application publication US 2007/0040325 A1 and its counterpart European Patent EP 1754675 B1.

There, there is described a "sheet handling apparatus" with a head station ("switchback section 1"). A feed transport path ("pre-path 2") leads to the head station 1, a discharge transport path ("post-path 3") leads away from the head station 1 and a bypass path 5 leads around the head station 1. Mail items are conducted by a switch G either into the feed transport path or into the bypass path 5, so that the processing time is the same both times. A length sensor 14' on the feed transport path 3 measures the length of each mail item, as seen in the transport direction.

The head station 1 has a "switchback roller 11" which can be driven in both directions. A controller 100 activates the drive of the roller 11 as a function of the measured length of the mail item. The longer the mail item is, the longer the roller 11 is rotated at increased speed. If there is a stipulated topology of the arrangement and a stipulated identical transport speed in the feed transport path 2 and in the discharge transport path 3, a uniform processing time can thereby be achieved even in the case of mail items having different lengths. A gap detector ("gap sensor 22") is located upstream of the switch W. The controller 100 regulates the head station such that the gap between two successive mail items after they pass through the merging point P2 is always the same. At this merging point P2, the mail items which are escorted via the feed transport path 2 and the discharge transport path 3 meet the mail items from the bypass path 5. Six sensors S1-S6 measure the transport rate ("conveyance rate") in the transport paths 2 and 3. Commonly assigned U.S. Pat. No. 7,306,219 B2 and German Patent DE 10 2004 026 362 B4 describe a direction reversal device which apportions a stream of mail items to two part streams. One part stream is led on one side past a driven drum and the other part stream is led past the same drum on the other side. The drum is rotated alternately in one direction and the other and thereby causes a reversal in the direction of the two part streams.

U.S. Pat. No. 7,694,953 B2 and its counterpart European patent application EP 1529747 A1 describe a "sheet processing apparatus 10" which transports flat articles. This apparatus 10 comprises a main transport path ("main conveying path 1"), a first head station ("first switchback portion 2a"), a second head station ("second switchback portion 4b") and a drum ("drum roller 1a"), cf. FIG. 1. A mail item is transported to a further transport path ("conveying path 6"), specifically along one of the following three routes: a first switch ("switching gate G1") deflects the mail item out of the main transport path 1 to the first head station 2a, and the mail item passes from there via a transport path 2b and a transport path 7 to the transport path 6. Or a second switch ("switching gate G2") deflects the mail item to the second head station 4b, and the mail item passes from there via the transport path 7 to the transport path 6. Or the mail item is transported to the drum 1a, and the transport path 1b steers the mail item past both head stations 2a, 4b to the transport path 6. The lengths of these three routes and the processing times are determined such that a mail item always requires the same time.

FIG. 4 of U.S. Pat. No. 7,694,953 B2 and EP 1529747 A1 show the first head station 2a in detail. A "carry-in conveying path 22" transports a mail item ("postal matter M") past a sensor S3 as far as a gap ("nip n") between two rollers 14, 16. The sensor S3 measures the length of the mail item. The rollers 14, 16 seize the mail item M. Two sensors 32, 33 detect the mail item M between the rollers 14, 16. The mail item M is stopped by time control ("at a predetermined timing"). A lever 28 deflects the stopped mail item M into a "discharge conveying path 23". This transport path 23 transports the mail item away.

U.S. Pat. No. 5,449,166 describes an apparatus and a method for the reversal of direction of flat articles, for example of flat mail items. A first transport unit ("first conveyor") transports the articles in a first transport direction and subsequently transfers them to a second transport unit ("second conveyor"). This second transport unit takes over the articles and transports them in a second transport direction via a stipulated transport path, stops the articles and transports them back again via the transport path in the opposite transport direction. A third transport unit ("third conveyor") takes over the articles and transports them in a third transport direction.

In one embodiment of U.S. Pat. No. 5,449,166, an acute angle $\alpha$ lies between the first transport direction and the second transport direction. An acute angle $\beta$ lies between the transport direction opposite to the second transport direction and the third transport direction.

A direction reversal device with a length sensor is also described in U.S. Pat. No. 7,080,834 B2 and its counterpart European patent application EP 1424299 A2. There, a feed transport device transports flat articles, for example mail items, to a head station. A discharge transport device transports these mail items away again. A length sensor measures the length of each mail item. The apparatus is regulated such that the gap between two successive mail items before they reach the head station is identical to the gap after they leave the head station. In one refinement, the "conveying pitch" remains the same, that is to say the sum of the length of a mail item and the following gap. In order to generate the uniform gap or the uniform "conveying pitch", the head station transports a mail item at increased speed for longer, the longer the mail item is.

United States patent application publication US 2007/0216085 A1 and its counterpart European patent application EP 1 834 910 A2 describe a franking machine for mail items with a "switchback apparatus 105". The "switchback apparatus 105" has two head stations ("switchback mechanism 2a, 4b") and a "by-pass mechanism" in the form of two "straight paths 1a, 1b". Furthermore, the "switchback apparatus 105" has a "main conveying path 1" which guides a mail item around a drum. A switch ("gate G1") conducts a mail item from the main path 1 into the head station ("switchback mechanism 2a"), and a further switch ("gate G2") conducts it out of the main path into the head station ("switchback mechanism 4b"). The mail items from the two head stations 2a, 4b and the mail items which remain in the main path 1 are combined again in a "joining unit 8", this being brought about by means of suitable lengths of the transport routes and acceleration and deceleration times. The head station 2a has a drive roller 14, which can be driven in both directions, and a running roller 16. A gap ("nip N") is formed between the rollers 14, 16. The head station 2a is delimited by two guide elements ("guide plates 21, 22"). A mail item is introduced into the head station along a feed transport path in a direction T1 and is drawn off again along a discharge transport path in the opposite direction T2. Three sensors measure whether a mail item is located in the head station 2a. Two rollers 45, 41 draw a, for example, jammed mail item out of the head station 2a, as required.

German published patent application DE 10 2006 027 872 A1 describes a transport system 4 with a spacing correction device 9, cf. FIG. 1. This transport system 4 transports a sequence of flat articles 2 past two light barriers 6 and 7 which measure the starting spacings and arrival spacings between two successive articles 2. The spacing correction device 9 can vary the spacing between two successive articles 2. The respective starting spacings in each case between two articles 2 are measured continuously, and a statistical distribution of these starting spacings is determined. The spacing correction device 9 is activated as a function of this statistical distribution.

SUMMARY OF THE INVENTION

It is accordingly an object of the invention to provide a method and an apparatus for the reversal of direction in the transport of articles which overcome the above-mentioned disadvantages of the heretofore-known devices and methods of this general type and which, even in the case of varying lengths of the articles to be transported, avoid the need for the direction reversal device to accelerate an article and which nevertheless prevent the first gap from undershooting the minimum direction reversal gap length.

With the foregoing and other objects in view there is provided, in accordance with the invention, a method for transporting at least two successive articles, the method which comprises the following steps:

stipulating a minimum direction reversal gap length;

placing two articles into sequence with one article forming a leading article and another article forming a trailing article, and with a first gap forming between the two articles;

transporting the two articles to a direction reversal device such that the first gap between the two articles is greater than or equal to the minimum direction reversal gap length, at least when the leading article reaches the direction reversal device;

transporting the two articles with the direction reversal device over a stipulated transport path in a transport direction and, subsequently, over the same transport path in an opposite transport direction;

wherein the direction reversal device:

first transports the leading article in the transport direction and then in the opposite transport direction; and subsequently transports the trailing article first in the transport direction and then in the opposite transport direction; and temporarily seizing the leading article solely by the direction reversal device and, subsequently temporarily seizing the trailing article solely by the direction reversal device;

transporting the two articles away from the direction reversal device such that a second gap occurs between the leading article and the trailing article; and measuring a length of the leading article as a dimension of the article, as seen in the transport direction, and using the dimension for transporting the leading article, stipulating a standard maximum length for an article to be transported;

if the measured length of the leading article is greater than the stipulated standard maximum length, carrying out the following steps:

forming the first gap greater than the stipulated minimum direction reversal gap length by a amount of a gap length supplement at the latest when the leading article reaches the direction reversal device;

the gap length supplement being greater than or equal to a difference between the measured length of the leading article and the standard maximum length;

transporting the leading article with the direction reversal device, during transport in the transport direction, over an entire transport path and, subsequently, over an additional transport route following the transport path; and transporting the leading article, during transport in the opposite transport direction with the direction reversal device, over the additional transport route and subsequently over the entire transport path; and, if the measured length is smaller than or equal to the standard maximum length:

terminating a transport of the leading article in the transport direction and commencing a subsequent transport in the opposite transport direction with the direction reversal device, no later than when the leading article has been transported over the entire transport path.

With the above and other objects in view there is also provided a corresponding apparatus which, according to the invention, possesses:

a gap generation device, a first transport device and a second transport device, a direction reversal device and a length measurement device.

The apparatus transports at least two successive articles.

The gap generation device produces a sequence of these two articles such that one article is a leading article and the other article is a trailing article, and a first gap occurs between these two articles when the leading article reaches the direction reversal device.

The length measurement device measures the length of the leading article exactly or at least approximately. This measured length is the dimension of this article, as seen in the transport direction in which the first transport device transports the first article.

When the measured length of the leading article is greater than a stipulated standard maximum length, the following step is carried out: the length generation device produces the first gap between the two articles such that the first gap is greater by the amount of a gap length supplement than a stipulated minimum direction reversal gap length at the latest when the leading article reaches the direction reversal device. In this case, the gap length supplement is greater than or equal to the difference between the measured length and the stipulated standard maximum length.

The first transport device transports the two articles to the direction reversal device such that the first gap between the two articles is greater than or equal to the minimum direction reversal gap length at the latest when the leading article has reached the direction reversal device.

The direction reversal device transports the two articles via a stipulated transport path in one transport direction and subsequently via the same transport path in the transport direction opposite the transport direction. In this case, the direction reversal device first transports the leading article in the transport direction and then in the opposite transport direction and subsequently transports the trailing article in the transport direction and then in the opposite transport direction. It is possible that the operations in which the direction reversal device transports the leading article and in which the direction reversal device transports the trailing article overlap one another in time.

If the measured length of the leading article is greater than the stipulated standard maximum length, the direction reversal device carries out the following steps:

- the direction reversal device transports the leading article, during transport in the transport direction, over the entire transport path and subsequently over an additional transport route. This additional transport route follows the transport path.
- the direction reversal device subsequently transports the leading article, during transport in the opposite transport direction, along the additional transport route and subsequently over the entire transport path.

If, by contrast, the measured length is smaller than or equal to the standard maximum length, the direction reversal device terminates the transport of the leading article in the transport direction at the latest and commences transport in the opposite transport direction at the latest when the leading article has been transported over the entire transport path. The additional transport route is not required for the leading mail item in this situation.

The second transport device transports the two articles away from the direction reversal device, specifically such that a second gap occurs between the two articles. This second gap may be exactly as long as the first gap or may differ from it.

According to the solution, the first gap is set at a length greater by the amount of the gap length supplement when the leading article is longer than the stipulated standard maximum length. Otherwise, the first gap may be identical to the stipulated minimum direction reversal gap length, thus making maximum throughput possible.

The invention enables an existing apparatus for direction reversal to be used further, even though the apparatus was originally designed only for those articles which, as seen in the transport direction, are no longer than the stipulated standard maximum length, and its gap generation device and transport path are configured for such articles. Such an apparatus is described in U.S. Pat. No. 5,449,166.

By virtue of the invention, it is possible to fulfill a wish, arising later, that the apparatus can transport even longer articles and reverse their direction, that is to say articles which are longer than the standard maximum length. "Later" means: after the design or after the construction of the apparatus. Sufficient space is required for the gap generation device and for the additional transport route. Both are often present in any case. A length measurement device is also mostly present in any case. The necessary changes to the already existing apparatus can be implemented simply by modifying the control of the gap generation device and of the direction reversal device, which can be achieved by reprogramming, without the hardware being modified. The mechanical components can therefore remain unchanged.

The additional transport route is required solely for reversing the direction of overlong articles, that is to say of articles which are longer than the standard maximum length. The remaining articles are transported solely in the transport direction and subsequently in the opposite transport direction, using the transport path.

According to the solution, the first gap is produced such that the leading article has left the transport path completely before the trailing article reaches the latter. A collision between the leading article transported in the opposite transport direction and the trailing article transported in the transport direction is thereby prevented.

The minimum direction reversal gap length is stipulated such that this freedom from collision is ensured when the leading article is no longer than the standard maximum length and the first gap is at least as large as the minimum direction reversal gap length. For each leading article which is no longer than the standard maximum length, a gap of equal length can be set in each case for the trailing article, thus simplifying the control and operation of the gap generation device. The direction reversal device requires only the transport path for direction reversal, and the minimum direction reversal gap length makes the necessary time available for this.

According to the solution, a larger first gap is produced for a longer article. This larger gap is required so that the direction reversal device has sufficient time to transport the longer article over the entire transport path and along the additional transport route.

According to the solution, the first gap is produced before the leading article has reached the direction reversal device. Even when the leading first article is overlong, the then larger first gap is produced beforehand. This refinement and the use of the additional transport route avoid the need for the direction reversal device to have to accelerate a long leading article in the transport direction. Furthermore, the direction reversal device does not need to accelerate an article to a speed which is higher than the speed at which the article is transported away from the direction reversal device. Such high acceleration or higher speed may mechanically stress or even damage the article and/or the direction reversal device. Moreover, long articles are often also heavier, and therefore acceleration requires greater force and/or longer time. By virtue of the invention, this acceleration can be avoided.

It becomes possible to transport the two articles at the same first speed to the direction reversal device and at the same second speed away from the direction reversal device. These identical speeds make it easier to seize the articles permanently and maintain a stipulated gap between the articles.

The first gap is preferably set at the lowest possible value in order to achieve maximum throughput through the direction reversal device. This lowest possible value may vary from article to article.

Preferably, in the case of an overlong leading article, the first gap is produced in that the trailing article is decelerated in relation to the leading article. For example, the leading article reaches a stipulated desired transport speed more quickly than the trailing article. Or the trailing article is braked.

Preferably, the direction reversal device always transports both articles in the transport direction and subsequently in the opposite transport direction at a speed which is lower than or equal to the feed speed at which the articles are transported to the direction reversal device and which is also lower than or equal to the discharge speed at which the articles are transported away from the direction reversal device.

In one refinement, the length measurement device either detects that the length of the leading article is smaller than the stipulated standard maximum length. In this case, the length does not need to be measured more accurately. Or, by contrast, if the length is greater than or equal to the standard maximum length, the length of the leading article is measured as accurately as is necessary for producing the first gap according to the solution.

Preferably, when the leading article is shorter than the standard maximum length, it is stopped such that a reference point of the article, after it has stopped, is located in a stipulated reference reversal region of the transport path. For example, the mid-axis of the stopped leading article is always located, with tolerance allowed, at a specific point along the transport path. The center of gravity of the leading article often also lies in or near this mid-axis. By contrast, the corresponding reference point of a longer article is transported over the entire reference reversal region. This refinement makes it possible to have a uniform direction reversal.

The flat articles are, for example, flat mail items (letters, cards, or the like), banknotes, chip cards, paper sheets or flat freight consignments or pieces of baggage. The term mail item is also referred to as a mail consignment.

Other features which are considered as characteristic for the invention are set forth in the appended claims.

Although the invention is illustrated and described herein as embodied in a method and apparatus for the reversal of direction in the transport of articles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In the exemplary embodiment, the invention is used for the transport of flat items of mail, also referred to as mail items (standard and large letters, postcards, catalogs and similar n-articles).

A quantity of mail items to be sorted is fed to a sorting plant. A separator ("singulator") individually separates the mail items. A stream of mail items spaced apart from one another leaves the separator and runs through a length measurement device. In this case, each mail item stands upright on one edge. The length measurement device

- measures the length of each mail item, as seen in the transport direction in which the mail item runs through the length measurement device, and
- detects on which of the two sides of the mail item the destination address and the franking mark are located.

It is desirable that a stream of upright mail items spaced apart from one another is generated, in which the destination address and the franking marks all point in the same direction. Such a stream is designated as a stream of oriented mail items. Each mail item in which the destination address and the franking mark still point in the wrong direction is rotated once about a vertical axis which stands perpendicularly to the transport direction. Any other, that is to say already correctly oriented mail item is not rotated at all in one refinement and is rotated twice about this vertical axis in another refinement.

In the exemplary embodiment, a mail item is moved permanently while the mail item is being rotated once or else twice about a vertical axis. The movement and rotation of the mail item are therefore superposed, and the rotations are carried out without the mail item being stopped.

In the exemplary embodiment, the sorting plant has at least one, preferably a plurality of parallel-connected direction reversal devices and a bypass device.

Figure 1:
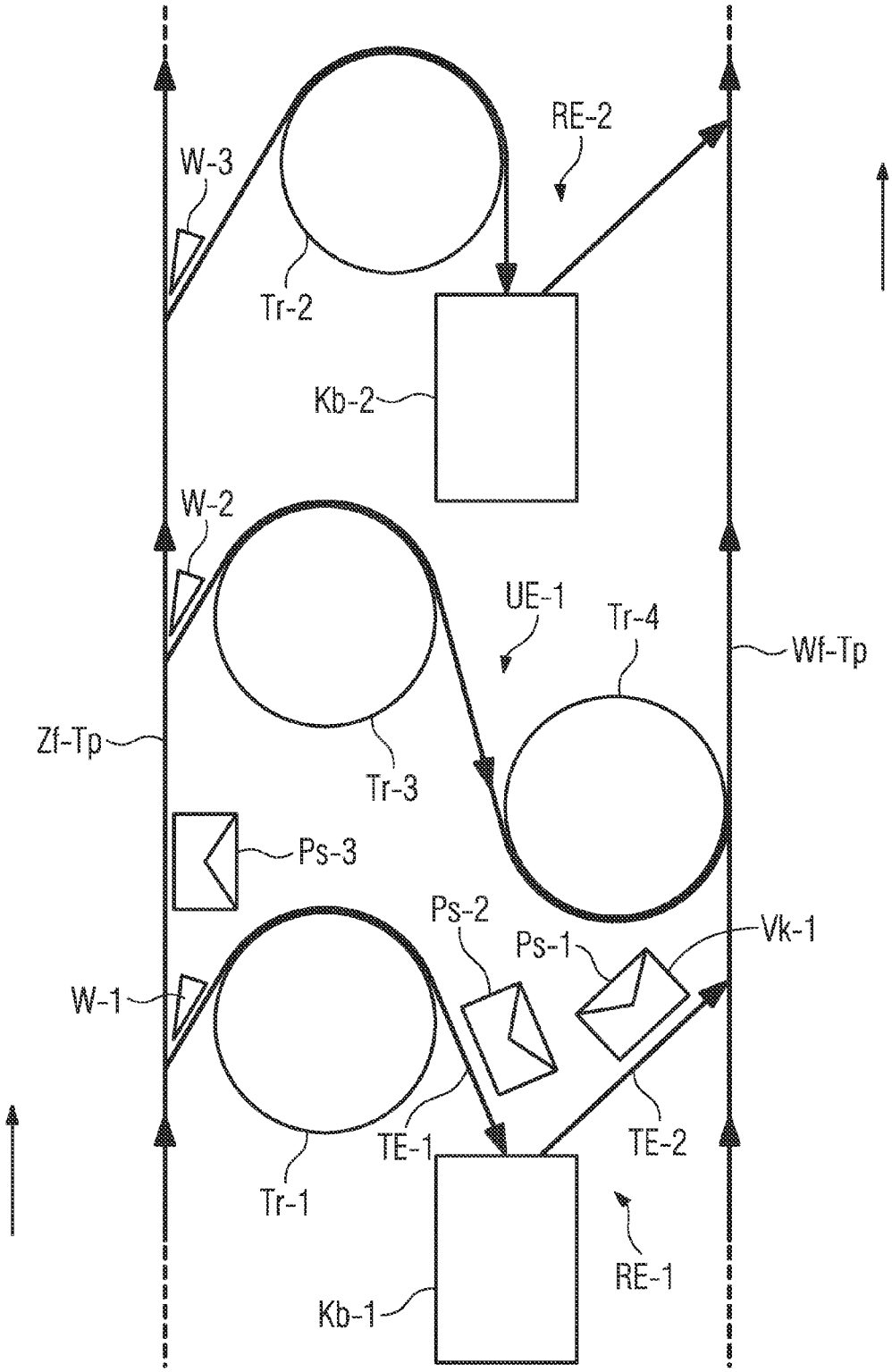
FIG. 1 shows an arrangement with two direction reversal devices and with a bypass device.

FIG. 1 shows by way of example an arrangement with two parallel-connected direction reversal devices and a bypass device.

A feed transport device transports each mail item on a feed transport path Zf-Tp past a sequence of switches W-1, W-2, W-3. In each switch W-1, W-2, W-3, a connecting path branches off which leads in each case to a direction reversal device RE-1, RE-2 or to the bypass device UE-1. For each bypass device UE-1 and each direction reversal device RE-1, RE-2, there is in each case exactly one switch in the feed transport path Zf-Tp. Each mail item subsequently runs through a further connecting path which leads to a discharge transport path Wf-Tp. The desired sequence of oriented mail items is then generated in the discharge transport path Wf-Tp.

The arrangement of FIG. 1 comprises a first direction reversal device RE-1, a second direction reversal device RE-2 and a bypass device UE-1. Three switches W-1, W-2, W-3 are arranged in succession in a feed transport path Zf-Tp. In the switch W-1 a transport path branches off to the first direction reversal device RE-1, in the switch W-2 a transport path branches off to the bypass device UE-1, and in the switch W-3 a transport path branches off to the second direction reversal device RE-2. These three connecting paths lead to the three devices RE-1, UE-1, RE-2. Three further connecting paths lead from these three devices to the discharge transport path Wf-Tp.

A discharge transport device transports the sequence of oriented mail items on the discharge transport path Wf-Tp to an address reader, which deciphers the respective address on each mail item, and to a checking unit which checks the franking mark.

Subsequently, the sequence of oriented mail items is transported through between a printer and a printing gate. The printer prints many or all of the mail items in succession, for example the printer cancelling a stamp, printing on a postmark, applying an advertising print or printing a new delivery address onto a mail item to be passed further on. The printer, when printing, presses a mail item to be printed against the printing gate. At the latest when a mail item is transported through between the printer and the printing gate, the mail item must be oriented so as to be printed on the front side.

Each direction reversal device RE-1, RE-2 comprises in each case

- a drum which is guided about a vertical axis and can be rotated about this axis, and
- a "head station" ("switchback unit").

In the arrangement of FIG. 1, the first direction reversal device RE-1 comprises a drum Tr-1 and a "head station" Kb-1. The second direction reversal device RE-2 comprises a drum Tr-2 and a "head station" Kb-2. The bypass device UE-1 possesses two drums Tr-3 and Tr-4.

A mail item which runs through the direction reversal device RE-1, RE-2 is guided around the drum Tr-1, Tr-2. This mail item is thereby also moved about a vertical axis during the rotation, that is to say is rotated, without being stopped. Moreover, the mail item runs through the "head station" Kb-1, Kb-2. The mail item is transported in a transport direction TR into the "head station" and is transported in the opposite transport direction TR-e out of the "head station" again.

In one refinement, the mail item is first guided around the drum Tr-1, Tr-2 and subsequently reaches the "head station" Kb-1, Kb-2. In an alternative refinement, a mail item first runs through the "head station" Kb-1, Kb-2 and is thereafter guided around the drum Tr-1, Tr-2.

The bypass device UE-1 preferably comprises two vertical drums Tr-3, Tr-4. Each mail item is guided first around one drum Tr-3 and subsequently around the other drum Tr-4.

The apparatus is configured such that a sequence of mail items in the feed transport path Zf-Tp is restored when the mail items have reached the discharge transport path Wf-Tp.

While a mail item is being transported along the feed transport path Zf-Tp, over a connecting path, through the "head station" Kb-1, Kb-2 or around a drum Tr-1, . . . , Tr-4 and along the discharge transport path Wf-Tp, the mail item is seized, without slip, by at least one transport device. Each transport device preferably comprises at least one endless conveyor belt which is guided around at least two, preferably three vertical axes or rollers, and a countertransport element. The countertransport element may likewise be an endless conveyor belt or else at least one roller which comes directly into contact with a transported mail item. Instead of the endless conveyor belt, a roller or a sequence of rollers coming directly into contact with the mail item may likewise be provided.

Preferably, each transport device temporarily clamps a mail item between two endless conveyor belts, which are rotated at the same speed, and thereby transports the mail items at this speed ("pinch-belt system").

A gap occurs between two mail items which are directly transported in succession along the feed transport path. This gap is at least as large as a stipulated minimum transport gap length. The same applies to two mail items in the discharge transport path.

The mail items with wrong orientation are apportioned alternately to the direction reversal devices RE-1, RE-2. This is explained by the following example:

Let Ps-1, Ps-3, Ps-2 be three mail items which are directly transported in succession in this sequence in the feed transport path Zf-Tp. If the first mail item Ps-1 is conducted into a first direction reversal device RE-1, the following mail item Ps-3 is steered into another direction reversal device RE-2 or else into the bypass device UE-1. The third mail item Ps-2 is steered again into the first direction reversal device RE-1 or into the bypass device. This depends on the orientation of the mail item Ps-2. In the example described below, the two mail items Ps-1 and Ps-2 pass successively into the first direction reversal device RE-1.

The action of the first direction reversal device RE-1 is described below. Each mail item which is diverted out of the feed transport path Zf-Tp into that connecting path which leads to the first direction reversal device RE-1 is first led around the drum Tr-1 and subsequently runs through the "head station" Kb-1 of the first direction reversal device RE-1.

Figure 2:
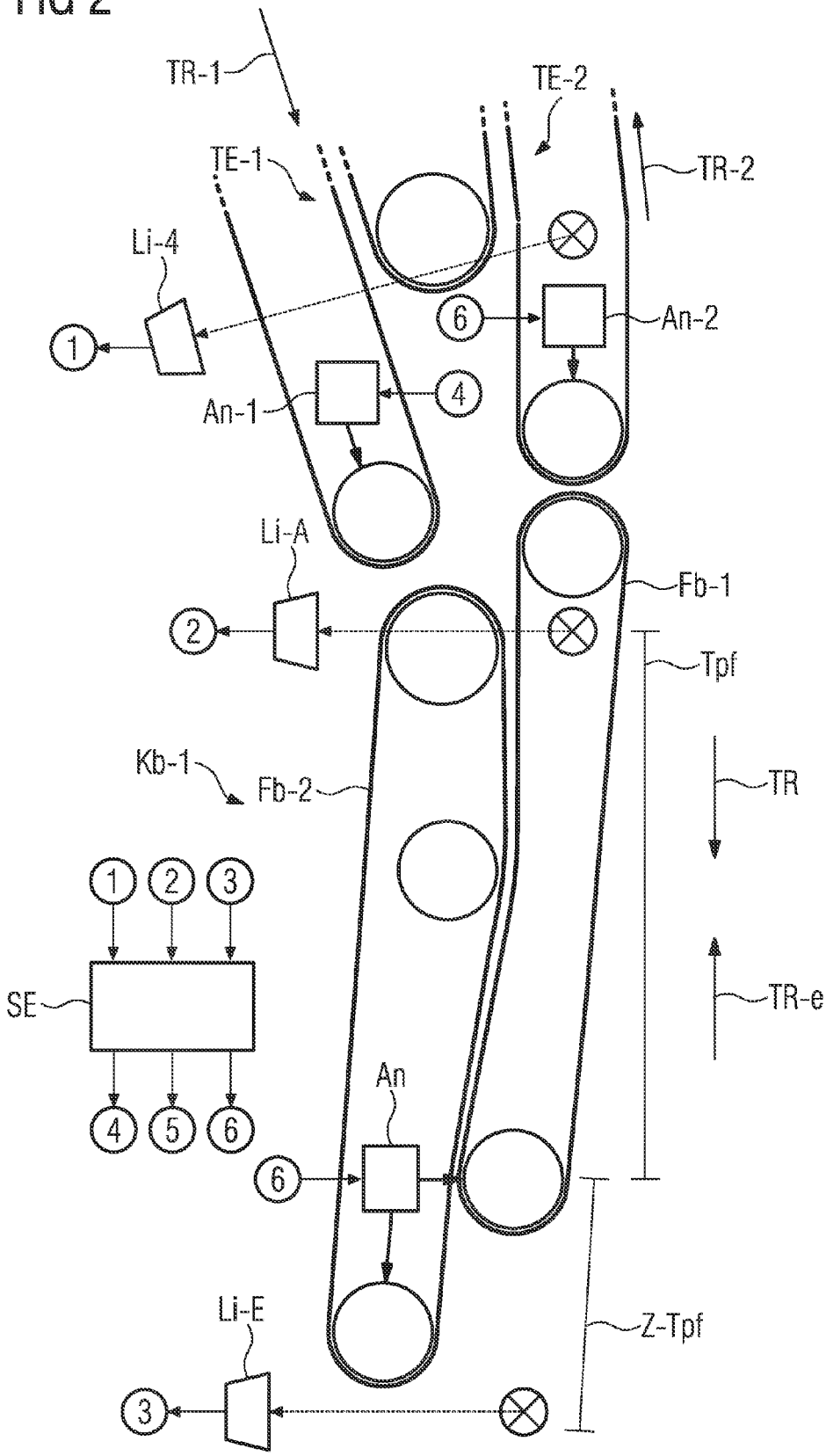
FIG. 2 shows the first "head station" of the arrangement of FIG. 1.

FIG. 2 shows this "head station" Kb-1 by way of example.

The "head station" Kb-1 comprises two endless conveyor belts Fb-1, Fb-2 which are guided in each case around three rollers. These two endless conveyor belts Fb-1, Fb-2 can temporarily clamp a mail item between them and transport it along a clamping transport section in which the mail items are clamped by the two conveyor belts Fb-1, Fb-2 and transported without slip. This clamping transport section forms part of a transport path of the first direction reversal device RE-1.

A first transport device TE-1 transports the mail items in a first transport direction TR-1 to the "head station" Kb-1. The first transport device TE-1 leads from the drum Tr-1 to the "head station" Kb-1. A preceding transport device leads from the switch W-1 to the drum Tr-1. A second transport device TE-2 transports the mail items in the second transport direction TR-2 away from the "head station" Kb-2 to the discharge transport path Wf-Tp.

The first transport device TE-1 and the second transport device TE-2 are also configured for transporting a mail item without slip. Between the clamping transport section of the first transport device TE-1 and the clamping transport section of the "head station" Kb-1 is located a transfer region in which a mail item is not seized. This transfer region is shorter than the shortest mail item is long, so that a mail item is seized at any time, specifically at least in a part region.

A light barrier Li-4 measures when the front edge of a mail item has reached the transfer region. A following start light barrier Li-A measures when the front edge of this mail item has reached the start of the clamping transport section of the "head station".

In the exemplary embodiment, the apparatus possesses a control unit SE. This control unit SE activates the direction reversal devices RE-1 and RE-2. In particular, the control unit SE activates the drives of the endless conveyor belts Fb-1, Fb-2. The light barriers Li-4 and Li-A transmit signals to the control unit SE.

The "head station" Kb-1 first transports a mail item in a transport direction TR until the rear edge of the mail item has passed the start light barrier Li-A. At this time point, the mail item is seized solely by the two endless conveyor belts of the "head station". The "head station" slows down and stops the mail item and accelerates it in a transport direction TR-e which is opposite to the transport direction TR. The front edge of the mail item passes the light barrier Li-4 and is seized by the second transport device TE-2. In the exemplary embodiment, the head station Kb-1 commences the braking of the fed mail item, as soon as the rear edge of the mail item has passed the light barrier Li-4, and terminates acceleration at the latest when the front edge has reached the light barrier Li-4 again. Preferably, therefore, braking is commenced as early as possible, and acceleration is terminated as late as possible.

A first acute angle $\alpha$ occurs between the first transport direction TR-1 and the transport direction TR. As soon as the mail item has left the clamping transport section of the first transport device TE-1 and reaches the "head station" Kb-1, the inherent rigidity of the mail item has the effect that a rear region of the mail item is folded approximately around the angle $\alpha$ and the longitudinal axis of the mail item points in the transport direction TR of the "head station" Kb-1. A second acute angle $\beta$ occurs between the opposite transport direction TR-e and the second transport direction TR-2. The second angle $\beta$ is preferably smaller than the first angle $\alpha$.

The "head station" Kb-1 carries out these steps for each mail item. In the above example, the first transport device TE-1 first transports the leading first mail item Ps-1 and the trailing mail item Ps-2. A first gap occurs between the leading mail item Ps-1 and the trailing mail item Ps-2. This first gap remains unchanged while the first transport device TE-1 is transporting the two mail items Ps-1, Ps-2 in the first transport direction TR-1. Subsequently, first the leading mail item Ps-1 runs through the "head station" Kb-1, as described above, and then the trailing mail item Ps-2 runs through the "head station". The first gap is dimensioned such that the leading mail item Ps-1 has left the "head station" Kb-1 completely before the trailing mail item Ps-2 reaches the "head station". Preferably, however, the first gap is also so small that, during a time span, both the leading mail item Ps-1 and the trailing mail item Ps-2 interrupt the light barrier Li-4. In this time span, the leading mail item Ps-1 is transported in the second transport direction TR-2 by the second transport device TE-2 and the trailing mail item Ps-1 is transported in the first transport direction TR-1 by the first transport device TE-1. The head station Kb-1 seizes first the leading mail item Ps-1 and then the trailing mail item Ps-2.

The second transport device TE-2 thereafter transports the two mail items Ps-1 and Ps-2 away such that a second gap occurs between the still leading mail item Ps-1 and the still trailing mail item Ps-2. This second gap may be equal to unequal to the first gap.

The first gap between the leading mail item Ps-1 and the trailing mail item Ps-2 is produced before the two mail items Ps-1, Ps-2 have reached the first transport device TE-1. The length of the first gap depends on the length of the leading mail item Ps-1. This length of the mail item Ps-1 is designated below by L-1. The length L-1 is measured before the first gap is produced, specifically by a length measurement device LME which is located upstream of the first transport device TE-1.

In one refinement, the separator ("singulator") possesses two separation stages. The first separation stage separate the two mail items Ps-1 and Ps-2, so that a gap occurs between the two mail items Ps-1 and Ps-2. Only after separation can the length of the leading mail item Ps-1 be measured. The length measurement device LME is arranged between the first separation stage and the second separation stage and measures the length L-1 of the separated leading mail item PS-1 and also the length of the gap between the two mail items Ps-1 and Ps-2. The second separation stage subsequently produces the first gap with a gap length which is stipulated by the second separation stage. If required, the second separation stage decelerates the trailing mail item Ps-2.

Figure 3:
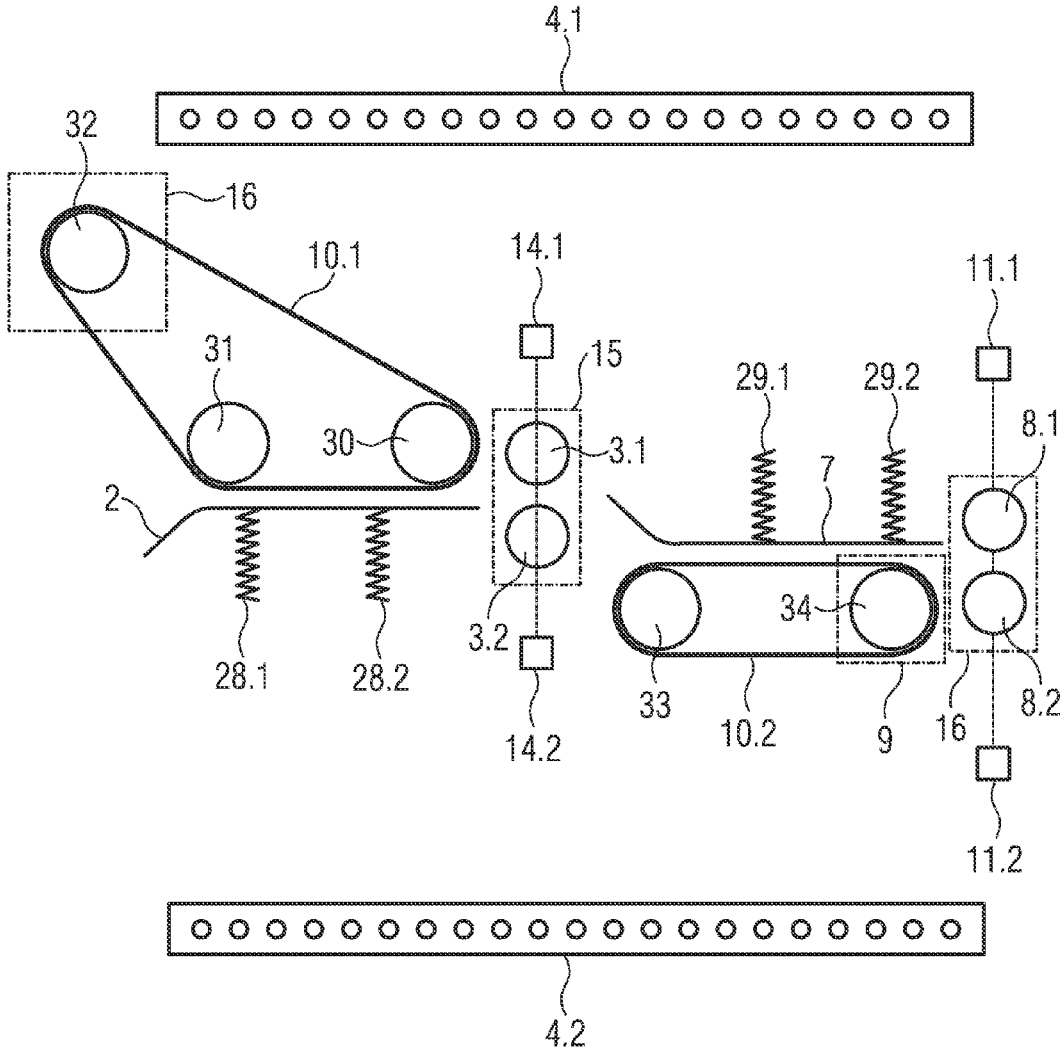
FIG. 3 shows an exemplary gap modification device as part of a two-stage separator.

FIG. 3 shows by way of example a separator with two stages. The first separation stage comprises a driven transport element 10.1 with a plurality of driving conveyor belts lying one above the other, and also a first retention element 2. Two compression springs 28.1, 28.2 press the first retention element 2 against the driving conveyor belts of the first transport element 10.1 to an extent such that only a stipulated minimum spacing remains between the first transport element 10.1 and the first retention element 2. The second separation stage possesses correspondingly a second transport element 10.2 and a second retention element 7.

The conveyor belts of the first transport element 10.1 are guided around three rollers 30, 31, 32. A drive 16 drives the roller 32. The conveyor belts of the second transport element 10.2 are guided around two rollers 33, 34. A drive 9 drives the roller 34.

Furthermore, the first separation stage comprises a first draw-forward element 3 with the two transport rollers 3.1, 3.2 which are both driven by the drive 15. The second separation stage comprises a second draw-forward element 8 with the two transport rollers 8.1, 8.2 which are driven by the drive 16.

Level with the first draw-forward element 3 is a light barrier 14 with a transmitter 14.1 and with a receiver 14.2. Level with the second draw-forward element 8 is a light barrier 11 with a transmitter 11.1 and with a receiver 11.2.

In one refinement, the separation stages operate in a start/stop mode. The two transport elements 10.1 and 10.2 are continuously started and stopped again. Each separation stage can be activated separately. As a result, the two-stage separator can produce a desired gap between two successive mail items.

While a mail item is being transported upright through this separator, the mail item runs through a light barrier 4. This light barrier 4 comprises a row 4.1 with transmitters and a row 4.2 with receivers. This light barrier 4 measures the length of the mail item as its dimension seen in the transport direction.

In another refinement, the feed transport device comprises a gap modification device LVE. The gap modification device LVE comprises two endless conveyor belts which can temporarily clamp a mail item between them. As soon as a mail item is seized and clamped solely by these two endless conveyor belts of the gap modification device LVE, the mail item is decelerated or accelerated in relation to a leading mail item. The gap between the two mail items is thereby modified.

Commonly assigned U.S. Pat. No. 7,687,737 B2 and its counterpart German patent DE 10 2004 012 378 B3 describe a gap modification device which can also be used for the apparatus of the exemplary embodiment. It is described there how a desired gap and a minimum gap between successive mail items are determined and how the gap modification device produces an actual gap between these mail items. As far as required and necessary for a proper understanding of the claimed invention, the patents and the other publications and patents cited in this specification are herewith expressly incorporated by reference.

In one refinement, the length measurement device LME comprises a light barrier row with a row 4.1 of transmitters and with a row 4.2 of receivers. A mail item is transported through between the transmitter row and the receiver row. A light beam emitted by a transmitter either impinges onto the assigned receiver or is interrupted by a mail item. How long a mail item is is measured, for example, from the product of the time span in which a mail item interrupts a light beam and the measured transport speed at which the mail item is transported through between the transmitter row and the receiver row. This length measurement device may be part of the two-stage separator which is shown in FIG. 3 or be installed elsewhere in the sorting plant, for example in the feed transport path Zf-Tp.

In another refinement, the length measurement device LME comprises a camera and an image evaluation unit. The camera generates an image of the mail item standing on a longitudinal edge, from an imaging direction which stands perpendicularly to that direction in which the mail item is transported past the camera. The image thus shows a face of the flat mail item. This image is transferred to the image evaluation unit. The image evaluation unit evaluates the image and thereby measures the length of the mail item as the extent of the mail item in the transport direction.

There are stipulated:

a standard maximum length L-max of a mail item and a minimum direction reversal gap length.

These two values are stored in a data memory. The control unit SE has reading access to this data memory.

A mail item may be longer than the standard maximum length L-max. The first gap is produced such that the length of the first gap is greater than or equal to the minimum direction reversal gap length. This ensures that a leading mail item Ps-1 has left the "head station" Kb-1 completely before the trailing mail item Ps-2 reaches the "head station".

Figure 4:
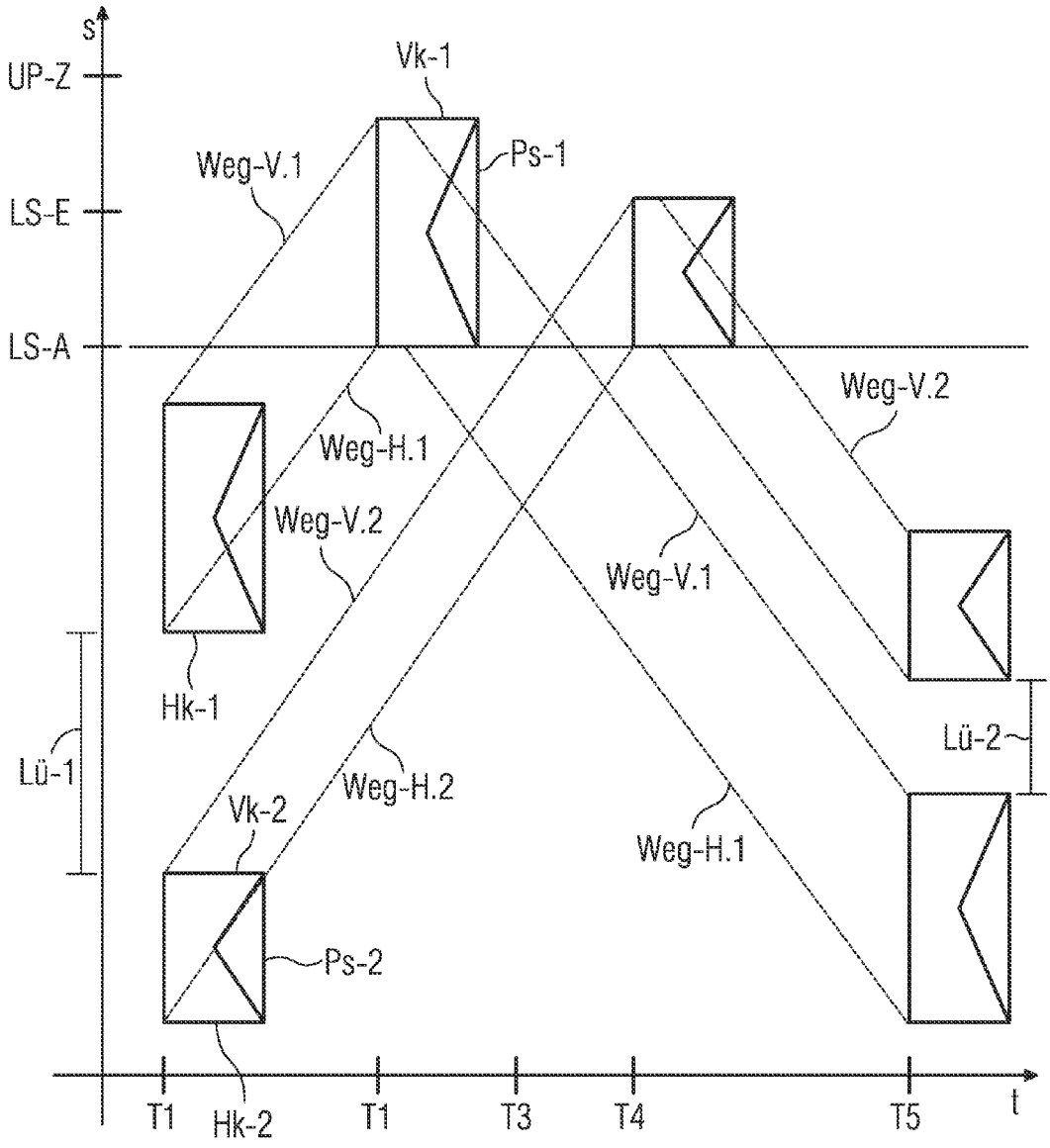
FIG. 4 shows a route/time graph for two successive mail items.

FIG. 4 shows a route/time graph diagrammatically. The time t is illustrated on the x-axis and the distance covered s on the y-axis. A leading longer mail item Ps-1 and a trailing shorter mail item Ps-2 are illustrated. The leading mail item Ps-1 has the front edge Vk-1 and the rear edge Hk-1 and the trailing mail item Ps-2 has the front edge Vk-2 and the rear edge Hk-2. The leading mail item Ps-1 has the length L-1>L-max. In FIG. 4, the lines route-V.1 describe the route of the front edge of the longer mail item Ps-1, route-H.1 the route of the rear edge of the longer mail item Ps-1, route-V.2 the route of the front edge of the shorter mail item Ps-2 and route-H.2 the route of the rear edge of the shorter mail item Ps-2.

At the time point T1, both mail items Ps-1, Ps-2 are still seized and transported solely by the first transport device TE-1. The first gap Lü-1 occurs between the two mail items Ps-1, Ps-2.

At the time point T2, the rear edge Hk-1 of the leading mail item Ps-1 has passed the start light barrier LS-A and is seized solely by the second transport device TE-2. The leading mail item Ps-1 partially utilizes the additional transport path Z-Tpf having the length L-Z. The longer mail item Ps-1 is thereupon braked and accelerated in the opposite transport direction TR-2*e*. The route/time profile of this direction reversal is illustrated in roughly simplified form in FIG. 4.

At the time point T3, the trailing mail item Ps-2 is at a shorter distance from the transport path Tpf than the leading mail item Ps-1.

At the time point T4, the rear edge Hk-2 of the trailing mail item Ps-2 has passed the start light barrier LS-A. The mail item Ps-2 is thereupon braked and accelerated in the opposite transport direction TR-2*e*E. The route/time profile of this direction reversal is also illustrated in roughly simplified form in FIG. 4.

At the time point T5, both mail items are seized only by the third transport device Te-3. The second gap Lü-2 has occurred between the two mail items Ps-1, Ps-2.

As already stated above, the feed transport device transports the mail items Ps-1, Ps-3 and Ps-2 successively via the feed transport path Zf-Tp. The two mail items Ps-1 and Ps-2 are diverted successively into the connecting path to the first direction reversal device RE-1, specifically preferably such that the length of the first gap between the two mail items Ps-1 and Ps-2 remains unchanged. The third mail item Ps-3 is located in the first gap between the two mail items Ps-1 and Ps-2 and is transported around the first direction reversal device RE-1. The trailing mail item Ps-2 therefore first follows directly behind the leading mail item Ps-1 in the connecting path to the "head station" Kb-1, and previously the third mail item Ps-3 is still located between the two mail items Ps-1 and Ps-2.

A gap, which is at least as long as a stipulated minimum transport gap length, is to occur between two mail items which are transported directly in succession in the feed transport path Zf-Tp. The first gap is therefore greater than or equal to the minimum direction reversal gap length and, moreover, greater than or equal to double the stipulated minimum transport gap length plus the third mail item Ps-3. At least the minimum transport gap length should occur between the leading mail item Ps-1 and the third mail item Ps-3, and at least this minimum transport gap length should also occur between the third mail item Ps-3 and the trailing mail item Ps-2. As a rule, the length of the first gap is fixed by the minimum transport gap length and by the length of the third mail item Ps-3 and is then "automatically" greater than the minimum direction reversal gap length.

The first gap, that is to say the gap between the mail items Ps-1 and Ps-2 which are transported to the first direction reversal device RE-1, is preferably set at a gap length which is as large as necessary and as small as possible. If the leading mail item Ps-1 is no longer than the standard maximum length L-max, the length of the first gap is preferably equal to the higher of the two values minimum direction reversal gap length and sum of double the minimum transport gap length and the length of the third mail item Ps-3.

If the leading mail item Ps-1 has a length L-1 which is greater than the stipulated standard maximum length L-max, the first gap is generated such that the length of the first gap is longer at least by the amount of a gap length supplement than the stipulated minimum direction reversal gap length. Moreover, in turn, the first gap is at least as large as the sum of double the minimum transport gap length and the length of the mail item Ps-3.

The gap length supplement is greater than or equal to the difference between the measured length L-1 of the leading mail item Ps-1 and the stipulated standard maximum length L-max. The gap length supplement is preferably equal to the difference L-1–L-max.

The two mail items Ps-1 and Ps-2 are transported, with this first gap between them, via the feed transport path as far as the switch to the connecting path and from the connecting path by means of the first transport device TE-1 as far as the "head station" of the first direction reversal device RE-1. The first gap maintains this same gap length until the rear edge of the leading mail item Ps-1 has passed the start light barrier Li-A of the "head station". Only then is the first gap modified, because the "head station" brakes the leading mail item Ps-1.

As already stated, the "head station" possesses a clamping transport section in which a mail item is transported without slip. This clamping transport section possesses a reference reversal region. This reference reversal region may be a single point or a subsection of the transport path Tpf.

A mail item which is no longer than the standard maximum length L-max is stopped by the "head station" such that a reference point of the mail item is located in the reference reversal region when the mail item is stopped. The reference point is, for example, the mid-point of the mail item, as seen in the transport direction TR. The reference reversal region is preferably located at half the length of the clamping transport section. The spacing between the reference reversal region and the start light barrier Li-A is such that a mail item which is stopped, as described above, is located completely in the "head station", that is to say the rear edge of the mail item has passed the start light barrier Li-A, when the mail item has stopped. The spacing between the reference reversal region and the start light barrier Li-A therefore amounts to at least half the maximum length L-max. However, this applies only to mail items which are no longer than the standard maximum length L-max.

A mail item which is longer than the standard maximum length L-max is likewise stopped being transported in the transport direction TR as soon as its rear edge has passed the start light barrier Li-A when the mail item has stopped. The reference point of the overlong mail item has at this time point, however, been transported through the reference reversal region and over a further distance in the transport direction TR. The front edge of the overlong mail item runs through the entire clamping transport section and the entire transport path Tpf and also an additional transport route Z-Tpf which follows the transport path Tpf. Only then is the overlong mail item stopped.

In one refinement, an end light barrier Li-E is arranged at the end of the additional transport route Z-Tpf or shortly before its end. This end light barrier Li-E measures the event that an overlong mail item has run through the end of the additional transport route Z-Tpf completely or almost completely. The end light barrier Li-E then sends a signal to the control unit SE. The control unit SE causes the head station Kb-1 to stop the mail item, so that this overlong mail item is not transported beyond the additional transport route Z-Tpf.

The invention claimed is:

1. A method for transporting at least two successive articles, the method which comprises the following steps:

stipulating a minimum direction reversal gap length;

placing two articles into sequence with one article forming a leading article and another article forming a trailing article, and with a first gap forming between the two articles;

transporting the two articles to a direction reversal device such that the first gap between the two articles is greater than or equal to the minimum direction reversal gap length, at least when the leading article reaches the direction reversal device;

transporting the two articles with the direction reversal device over a stipulated transport path in a transport direction and, subsequently, over the same transport path in an opposite transport direction;

wherein the direction reversal device:

first transports the leading article in the transport direction and then in the opposite transport direction; and subsequently transports the trailing article first in the transport direction and then in the opposite transport direction; and temporarily seizing the leading article solely by the direction reversal device and, subsequently temporarily seizing the trailing article solely by the direction reversal device;

transporting the two articles away from the direction reversal device such that a second gap occurs between the leading article and the trailing article; and measuring a length of the leading article as a dimension of the article, as seen in the transport direction, and using the dimension for transporting the leading article, stipulating a standard maximum length for an article to be transported;

if the measured length of the leading article is greater than the stipulated standard maximum length, carrying out the following steps:

forming the first gap greater than the stipulated minimum direction reversal gap length by a amount of a gap length supplement at the latest when the leading article reaches the direction reversal device;

the gap length supplement being greater than or equal to a difference between the measured length of the leading article and the standard maximum length;

transporting the leading article with the direction reversal device, during transport in the transport direction, over an entire transport path and, subsequently, over an additional transport route following the transport path; and transporting the leading article, during transport in the opposite transport direction with the direction reversal device, over the additional transport route and subsequently over the entire transport path; and, if the measured length is smaller than or equal to the standard maximum length:

terminating a transport of the leading article in the transport direction and commencing a subsequent transport in the opposite transport direction with the direction reversal device, no later than when the leading article has been transported over the entire transport path.

2. The method according to claim 1, wherein the leading article has a front edge, and the method further comprises:

if the measured length of the leading article is greater than the stipulated standard maximum length;

transporting the leading article with the direction reversal device in the transport direction and then stopping the transport such that, during transport in the transport direction, the front edge of the leading article points forward in the transport direction; and during transport in the transport direction, transporting the front edge of the leading article along an additional transport route over a section having a length proportional to a difference between the measured length and the stipulated standard maximum length.

3. The method according to claim 1, which comprises:

transporting the two articles with the direction reversal device such that each article is stopped temporarily between transport in the transport direction and transport in the opposite transport direction; and if the measured length of the leading article is smaller than or equal to the stipulated standard maximum length, stopping the leading article with the direction reversal device such that a reference point of the leading article lies in a reference reversal region of the transport path;

if the measured length is greater than the standard maximum length;

stopping the leading article with the direction reversal device only after the reference point of the article has been transported through the entire reference reversal region.

4. The method according to claim 1, which comprises:

stipulating a minimum transport gap length; and transporting a third article such that the third article is temporarily located in the first gap between the two successive articles while the two successive articles are transported to the direction reversal device;

transporting the third article around the direction reversal device and inserting the third article into the second gap between the two successive articles while the two successive articles are transported away from the direction reversal device;

thereby forming a respective gap between the leading article and the third article and also between the third article and the trailing article, with a length of the gap being as great as the stipulated minimum transport gap length, at least as long as the third article is located in the first gap or in the second gap between the two successive articles.

5. The method according to claim 4, which comprises measuring a length of the third article and forming the first gap with a value greater than or equal to a sum of:

a measured length of the third article; and twice the minimum transport gap length.

6. The method according to claim 1, wherein, at least when a measured length of the leading article is greater than the standard maximum length, the step of producing the first gap comprises decelerating the trailing article in relation to a movement of the leading article.

7. An apparatus for transporting two articles in succession, the apparatus comprising:

a gap generation device;

a length measurement device;

a first transport device;

a direction reversal device; and a second transport device;

said gap generation device being configured for producing a sequence between the two articles with one article being a leading article and the other article being a trailing article, and a first gap being formed between the two articles;

said length measurement device being configured for measuring a length of the leading article as a dimension of this article, as seen in the transport direction;

said first transport device being configured for transporting the two articles to said direction reversal device with the first gap between the two articles being greater than or equal to a stipulated minimum direction reversal gap length no later than when the leading article reaches said direction reversal device;

said direction reversal device being configured for transporting the two articles over a stipulated transport path in a transport direction and, subsequently, in an opposite transport direction over the transport path;

said direction reversal device being configured:

first, for transporting the leading article in the transport direction and then in the opposite transport direction and;

subsequently, for transporting the trailing article in the transport direction and then in the opposite transport direction; and wherein, first, the leading article is temporarily seized solely by said direction reversal device and, subsequently, the trailing article is temporarily seized solely by said direction reversal device, and said second transport device being configured for transporting the two articles away from said direction reversal device with a second gap established between the two articles; and wherein the measured length of the leading article is used for transporting the article;

if the measured length of the leading article is greater than a stipulated standard maximum length:

said gap generation device produces the first gap in such a way that the first gap is greater than a stipulated minimum direction reversal gap length by a amount of a gap length supplement no later than when the leading article reaches said direction reversal device, with the gap length supplement being greater than or equal to a difference between the measured length and the standard maximum length;

said direction reversal device transporting the leading article, during a transport thereof in the transport direction, over an entire said transport path and, subsequently, over an additional transport route following the transport path; and said direction reversal device transporting the leading article, during a transport thereof in the opposite transport direction, over the additional transport route and, subsequently, over the entire said transport path; and if the measured length of the leading article is smaller than or equal to the standard maximum length:

said direction reversal device terminates the transport of the leading article in the transport direction no later than, and commences a transport thereof in the opposite transport direction, no later than, when the leading article has been transported over the entire said transport path.

8. The apparatus according to claim 7, wherein said gap generation device is an integral part of a two-stage separator.

* * * * *